US009617987B2

(12) United States Patent
Wright et al.

(10) Patent No.: US 9,617,987 B2
(45) Date of Patent: Apr. 11, 2017

(54) PUMP FOR DOSING FLUIDS

(75) Inventors: Keith E. Wright, Chatham (GB); Michael Peter Cooke, Gillingham (GB); Neil C. Smith, Gravesend (GB); Martin Paul Hardy, Gillingham (GB); Ivan C. Lawford, Gillingham (GB); Kevin S. Stanbury, Rochester (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 1199 days.

(21) Appl. No.: 13/168,353

(22) Filed: Jun. 24, 2011

(65) Prior Publication Data

US 2012/0003110 A1 Jan. 5, 2012

(30) Foreign Application Priority Data

Jul. 2, 2010 (EP) ..... 10168274

(51) Int. Cl.
*F04B 39/12* (2006.01)
*F04B 53/16* (2006.01)

(52) U.S. Cl.
CPC ..... *F04B 39/126* (2013.01); *F04B 53/166* (2013.01); *F04B 53/168* (2013.01); *F01N 2610/02* (2013.01); *F01N 2610/1433* (2013.01); *F05C 2201/0454* (2013.01); *Y10T 29/49236* (2015.01)

(58) Field of Classification Search
CPC ..... F04B 13/00; F04B 53/166; F04B 19/12; F04B 23/02–23/026; F04B 23/10; F04B 17/04–17/048; F04B 39/041; F04B 39/126; F04B 39/1093; F04B 53/168; F01N 2610/1433; F01N 2610/02; F05C 2201/0454; Y10T 29/49236
USPC ..... 417/490, 417, 569, 571
See application file for complete search history.

(56) References Cited

U.S. PATENT DOCUMENTS 1,735,117 A * 11/1929 Kiger et al. ..... 137/538
2,222,823 A 11/1940 Parenti
(Continued)

FOREIGN PATENT DOCUMENTS

EP 1 878 920 1/2008
GB 2281359 3/1995
(Continued)

OTHER PUBLICATIONS

Taylor, E. Wilfred. "Correlation of the Mohs's Scale of Hardness with the." Jun. 23, 1949: 718-21. Print.*
(Continued)

*Primary Examiner* — Devon Kramer
*Assistant Examiner* — Joseph Herrmann
(74) *Attorney, Agent, or Firm* — Joshua Melaines

(57) ABSTRACT

A pumping assembly is provided which is suitable for use in a variety of dosing pumps. The pumping assembly comprises a pump body with a pump bore, and a sleeve fixed within the pump bore. The sleeve has a first end, a second end and a sleeve bore. A plunger is adapted to enter the first end of the sleeve and to reciprocate within the sleeve bore. The sleeve has at least one port to allow fluid flow through a wall of the sleeve. The, or each, port is elongated in a direction substantially orthogonal to a direction of reciprocation.

4 Claims, 4 Drawing Sheets

(56) References Cited

U.S. PATENT DOCUMENTS

| | | | | |
|---|---|---|---|---|
| 2,569,233 | A * | 9/1951 | Dickson et al. | F02M 49/02 123/502 |
| 2,869,945 | A | 1/1959 | Mattingly | |
| 3,614,944 | A * | 10/1971 | Ulbing | F01M 3/02 123/446 |
| 3,838,943 | A * | 10/1974 | Ulbing | F01M 3/02 417/225 |
| 3,885,895 | A * | 5/1975 | Staudt et al. | 417/499 |
| 4,424,012 | A | 1/1984 | Wesmoreland | |
| 4,441,868 | A * | 4/1984 | Fiedler et al. | 417/490 |
| 4,743,179 | A * | 5/1988 | Waas et al. | 417/417 |
| 4,758,135 | A * | 7/1988 | Woodward et al. | 417/559 |
| 4,808,092 | A * | 2/1989 | Funke | 417/454 |
| 4,934,907 | A * | 6/1990 | Kroner | 417/417 |
| 5,071,324 | A * | 12/1991 | Ishimoto | 417/490 |
| 5,372,115 | A * | 12/1994 | Straub | F02M 37/0064 123/1 A |
| 5,860,798 | A | 1/1999 | Tschopp | |
| 6,279,454 | B1 * | 8/2001 | Nishioka | F02M 59/445 92/169.1 |
| 6,283,733 | B1 | 9/2001 | Merklein et al. | |
| 6,334,762 | B1 | 1/2002 | Hauser et al. | |
| 6,539,708 | B1 * | 4/2003 | Hofmann et al. | 60/286 |
| 7,000,381 | B2 * | 2/2006 | Maisch | B01D 53/90 123/498 |
| 2003/0103854 | A1 | 6/2003 | Kim et al. | |
| 2004/0052664 | A1 * | 3/2004 | Saito et al. | 417/490 |
| 2008/0087739 | A1 * | 4/2008 | Tarabulski et al. | 239/11 |
| 2009/0114292 | A1 * | 5/2009 | Shafer et al. | 137/512 |
| 2010/0046862 | A1 | 2/2010 | Schubert | |

FOREIGN PATENT DOCUMENTS

| | | |
|---|---|---|
| JP | 62-165586 | 7/1987 |
| JP | 2003-172260 A | 6/2003 |
| WO | 96/01946 | 1/1996 |

OTHER PUBLICATIONS

Nata, Kwa Zulu. "Stainless Steel Grades and Mechanical Properties." Stainless Steel Grades and Mechanical Properties. Stainless Kwa Zulu Nata, Nov. 7, 2007. Web. Jan. 10, 2014.*
European Search Report dated Dec. 2, 2010.
European Search Report dated Oct. 10, 2011.
English Translated Japan Office Action dated Mar. 11, 2013.

* cited by examiner

PUMP FOR DOSING FLUIDS

FIELD OF INVENTION

The present invention relates to a pump for dosing fluids and for components for use in such a pump.

BACKGROUND TO THE INVENTION

Pumps for dosing fluids are required in a number of technical contexts. In certain of these technical contexts, it is desirable for the dose provided by the pump to be controllable with great accuracy, and for one pump to provide very similar dosing outputs to another pump according to the same design. One such technical context is the dosing of urea solution into the exhaust system of an internal combustion engine to allow a selective catalytic reduction (SCR) catalyst to reduce oxides of nitrogen. A dosing system for this purpose is described in EP1878920.

In practice, it is difficult to achieve very high levels of dosing control together with very high levels of consistency in dosing performance between different pumps manufactured according to the same design. It is desirable to address this difficulty without increasing complexity and cost in the manufacturing process.

SUMMARY OF THE INVENTION

Accordingly, the invention provides a pumping assembly comprising: a pump body with a pump bore, and a sleeve fixed within the pump bore and having a first end, a second end and a sleeve bore; and a plunger adapted to enter the first end of the sleeve and to reciprocate within the sleeve bore, wherein the sleeve has at least one port to allow fluid flow through a wall of the sleeve, and wherein the at least one port is elongated in a direction substantially orthogonal to a direction of reciprocation.

Such an assembly may be used in a variety of dosing pump structures, for different pump types—such as an armature pump—and for different purposes. This arrangement allows for effective manufacture of a pump whose dosing properties may be accurately determined such that pumps made to the same design will have very similar dosing properties—in particular, the start of the dosing process will be well controlled. This renders this type of pumping assembly particularly suitable for use in a pump for dosing a chemical reagent into an exhaust pipe of an internal combustion engine, such as a pump used to provide a reducing agent such as urea for selective catalytic reduction.

Advantageously, said at least one port is formed as an elongate slot—preferably, the long edges of the elongate slot formed with the sleeve bore are substantially orthogonal to an axis of the sleeve bore. This allows for particularly precise control of the start of the dosing process, and hence of the dosing properties of a pump comprising such a pump assembly.

Advantageously, the pumping assembly comprises two or more ports each formed as an elongate slot, and wherein the long edges of the elongate slot formed with the sleeve bore are substantially parallel to each other. In such an arrangement, it is desirable if one of the two or more ports has a leading edge closer to the second end of the sleeve than the leading edge of any other of the two or more ports, wherein the leading edge of a port is the long edge of the port closer to the second end of the sleeve. If this is the case, only this nearest leading edge is critical to the control of the start of the dosing process, and the other ports need not be formed with the same degree of precision.

The pump body may comprises a gallery around the at least one port of the sleeve to form a fluid path with the at least one port. This may provide practical advantages, such as the provision of balanced forces around the sleeve.

In an alternative arrangement, the at least one port comprises an annular groove formed on an inner surface of the sleeve. This allows for additional flexibility in manufacture at the assembly stage and provides a more symmetrical, and hence more balanced, arrangement around the plunger.

In one preferred arrangement, both the sleeve and the plunger are formed of a harder material than the pump body. The harder material may be a martensitic steel (such as a high nitrogen steel), with the pump body formed of a ferritic steel. This allows only the components whose dimensions are critical for accurate dosing to be formed of harder material, and for other components to be formed from a conventional material which can be machined more easily, although with less exact tolerance.

In a further aspect, the invention provides a sleeve adapted for use as the sleeve of a pumping assembly as described above.

In a still further aspect, the invention provides a method of manufacturing a pumping assembly comprising: forming a pump body with a pump bore; forming a sleeve having a first end, a second end and a sleeve bore from a harder material than the pump body, and forming at least one port in the sleeve capable of allowing fluid flow through a wall of the sleeve; fixing the sleeve in the pump bore; and mounting a plunger such that it enters the first end of the sleeve and such that it is adapted to reciprocate within the sleeve bore.

Advantageously, the at least one port is formed by grinding an elongate slot in the sleeve such that the long edges of the elongate slot formed with the sleeve bore are substantially orthogonal to an axis of the sleeve bore. This allows for effective manufacture of a dimension which is of particular importance in ensuring accurate and reproducible dosing.

Preferably, fixing the sleeve to the pump body comprises press fitting the sleeve in the pump body.

BRIEF DESCRIPTION OF DRAWINGS

Embodiments of the invention will now be described, by way of example, with reference to the accompanying Figures, of which.

DESCRIPTION OF EMBODIMENTS

Figure 1:
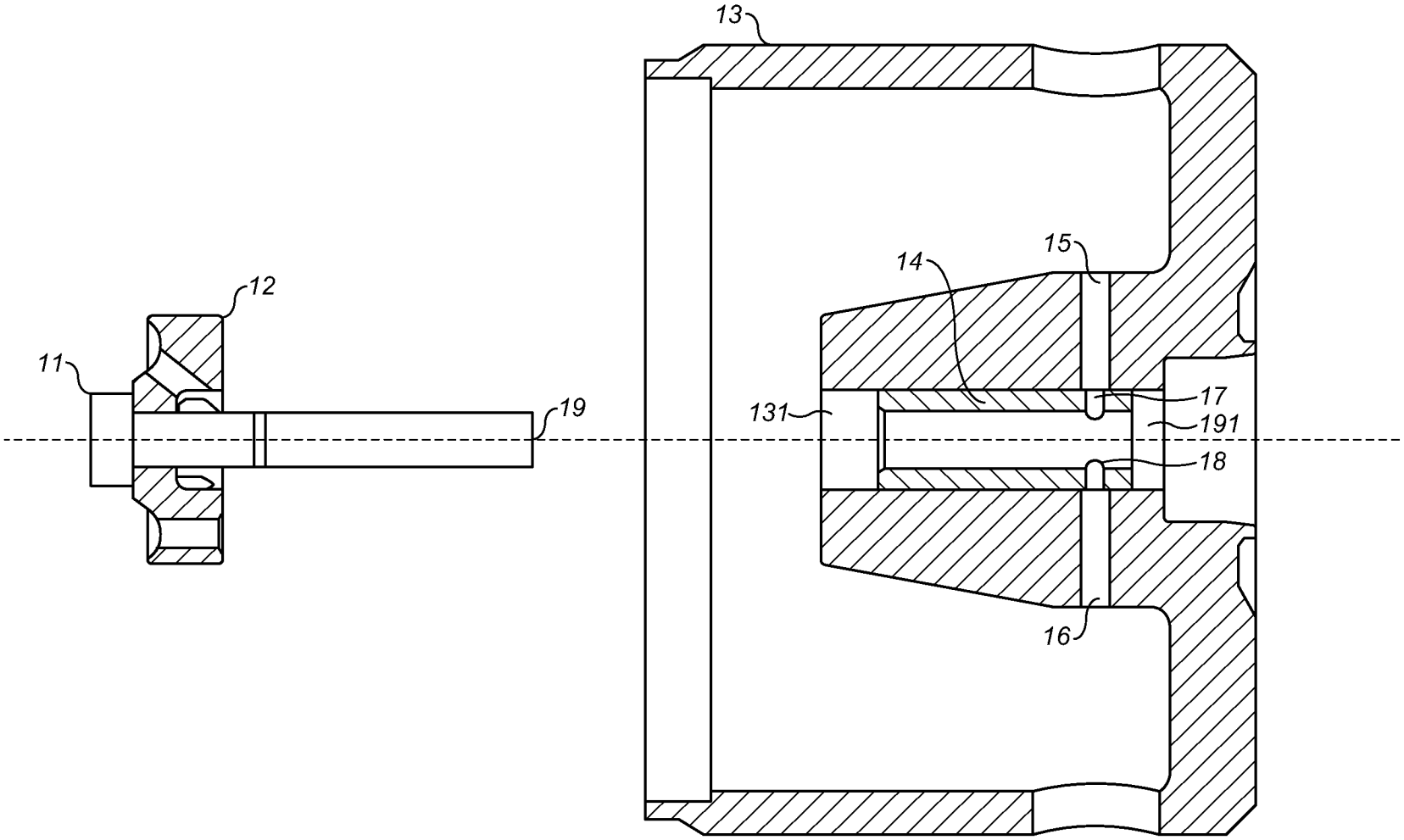
FIG. 1 shows components of a pump according to an embodiment of the invention.

FIG. 1 shows components of a pump in accordance with an embodiment of the invention. The pump comprises a plunger 11 adapted to reciprocate in a bore 131 of a pump body 13 with fluid feed ports 15, 16 allowing for passage of fluid into the bore 131 such that passage of fluid through the fluid feed ports 15, 16 is blocked when leading face 19 of the plunger advances sufficiently far into the bore 131. Embodiments of the invention may generally be provided for pumps comprising these elements, whatever the overall structure and operating principle of the pump. FIG. 1 shows an armature pump structure, with the plunger 11 located in an armature 12, for example by press fitting. This structure is appropriate for a dosing pump, such as a dosing pump for introducing a chemical agent such as urea into an exhaust system of an internal combustion engine. Other elements of the pump are not shown here as their design is not affected by the design of embodiments of the invention. An example of an overall pump structure that may readily be adapted by incorporation of an embodiment of the invention as described here is set out in EP 1878920.

A diameter of the bore 131 itself is significantly greater than the diameter of the plunger 11, but the leading face 19 of the plunger 11 reciprocates within an additional element, sleeve 14. A pumping chamber 191 is thus partly defined by the leading face 19 of the plunger 11 and the interior side walls of the sleeve 14. The sleeve 14 is cylindrical, and is fixed within the bore 131 of the pump body 13, for example by press fitting. The plunger 11 and the armature 12 thus form one subassembly, and the pump body 13 and the sleeve 14 form another subassembly.

Figure 2C:
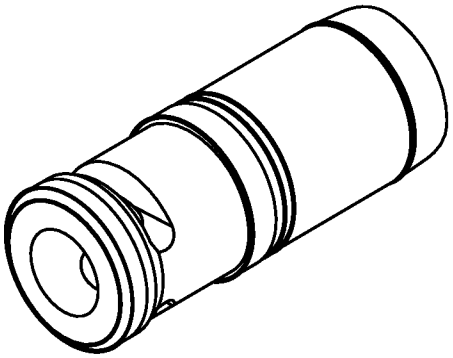
FIGS. 2A to 2D show different views of the sleeve of FIG. 1.
Figure 2B:
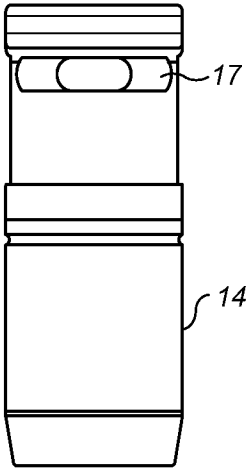
Figure 2A:
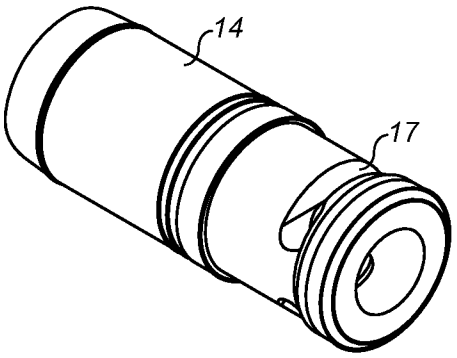
Figure 2D:
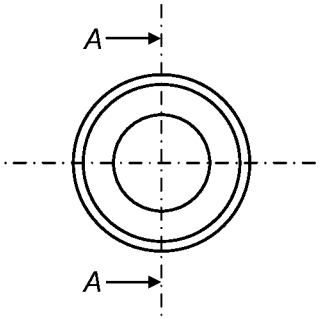
Figure 2D:
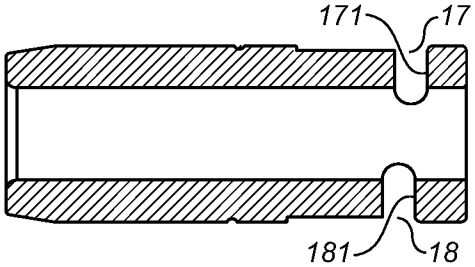

The sleeve 14 is shown in more detail in FIGS. 2A to 2D. The sleeve 14 contains at least one slot 17, 18 which extends substantially orthogonally to a central axis of the sleeve. The slots 17, 18 are straight, and where there are two or more slots these should be parallel to each other. The sleeve 14 as shown in FIGS. 1 and 2 has two slots 17, 18, slot 17 having a leading edge 171 and slot 18 having a leading edge 181 as indicated in FIG. 2D, though the number of slots provided may be determined by the overall structure of the pump and in particular the feed port arrangement that is required. In this case, the slots 17, 18 each communicate with one of the fluid feed ports 15, 16 of the pump body 13. In this arrangement, the fluid feed ports 15, 16 may simply be a part of an annular fluid feed chamber, or gallery, formed in the pump body 13. In this case, the feed ports for the pumping chamber are effectively defined by the slots 17, 18 formed in the sleeve 14.

While the slots 17, 18 should be parallel to each other, one of the slots 17 may be located further in to the pumping chamber 191 than the other slot 18. In such an arrangement, the leading edge 171 of the slot 17 will define the point at which fluid starts to flow between the fluid feed ports 15, 16 and the pumping chamber 191 and its disposition will be of particular importance in determining the dosing performance of the resulting pump. In this case, it will be desirable to control the formation of the slot 17 with sufficient accuracy to control the accuracy of dosing provided by the pump, but it may not be necessary to control the formation of the leading edge 181 of the other slot 18 with the same level of accuracy as this will be of less significance to the performance of the pump.

Machining of a slot such as slot 17 (or slot 18, if required) may be carried out by conventional machining processes with high levels of accuracy, allowing the production of a pump with very well controlled dosing properties. In particular, slots 17 and 18 may be formed by grinding rather than by drilling (as would be required for a fluid port which is defined by a bore). This also allows for more effective deburring of the port edges than would be possible with a drilled port. Where the sleeve 14 is manufactured from a harder material than the pump body 13, this also allows for precise manufacture, particularly by grinding, to achieve tolerances of the order of 0.005 mm on key component dimensions. A suitable material is a martensitic steel—a stainless steel such as 440C or high nitrogen steel such as XD15NW or XD15TN—this could also be used for the plunger 11. Use of a hard material for these components, but not for the armature 12 or the pump body 13 (which may be made of a conventional terrific steel), allows components that are key for dosing to be manufactured with demanding tolerances, while allowing more complex elements of the pump to be manufactured more easily from a softer material. This allows the process of manufacturing a dosing pump to be simplified without compromise to the effectiveness of the resulting pump.

Figure 4A:
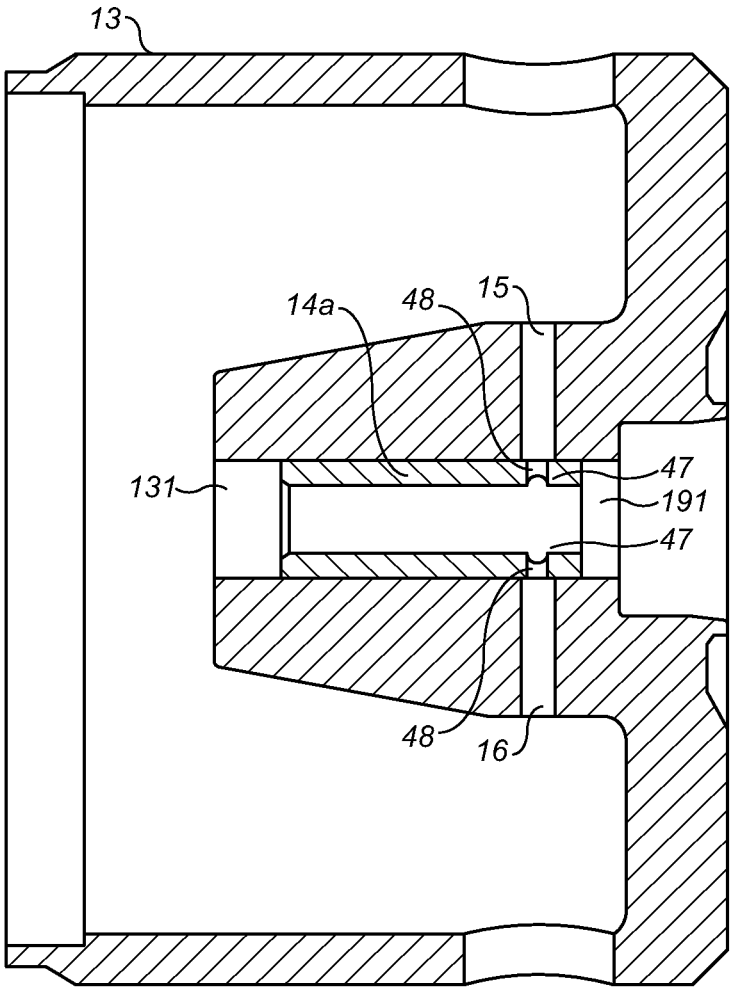
FIG. 4A shows components of a pump according to a further embodiment of the invention.
Figure 4B:
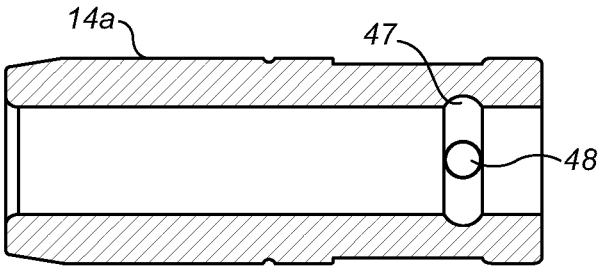
FIG. 4B shows a sectional view of the sleeve of FIG. 4A from above.

FIGS. 4A and 4B show components of a pump in accordance with another embodiment of the invention. The embodiment of FIGS. 4A and 4B largely resembles that of FIG. 1, and the same reference numerals are used for components which are essentially common to the two embodiments. The plunger is as for FIG. 1 and is not shown in FIG. 4A.

Figure 3:
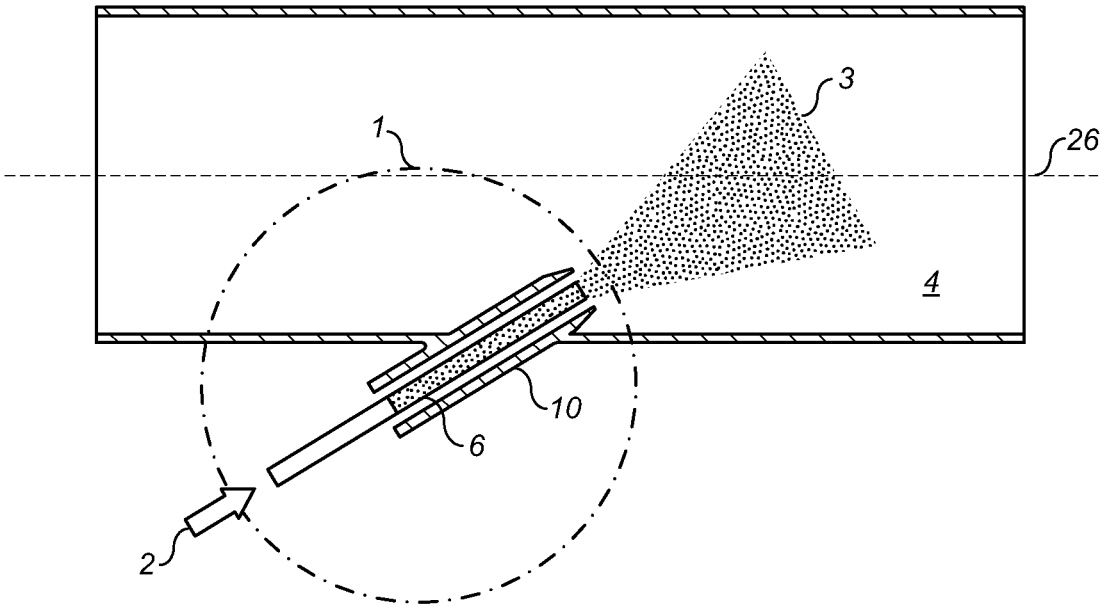
FIG. 3 shows the use of a pump such as those according to embodiments of the invention for dosing a liquid into the exhaust system of an internal combustion engine.

In the embodiment of FIGS. 4A and 4B, the sleeve 14*a* contains, instead of elongated slots, an annular groove 47 extending around the inner surface of the sleeve 14*a*. This annular groove acts as a single elongated port extending around a whole inner diameter of the sleeve. This groove 47 is then connected to the fluid passage through the pump body by one or more bores 48 in communication with the fluid feed ports 15, 16 in the pump body 13—in this case, two bores 48 are provided, one at the top and one at the bottom of the sleeve 14*a* as shown (as best seen in the section shown in FIG. 4B). This approach has certain advantages. It offers more flexibility for adjustment at the point of constructing the whole assembly, and it provides a more symmetric and hence balanced port arrangement around the plunger FIG. 3 shows an example of a pumping system in which embodiments of the present invention may be used effectively. This shows a structure for reducing exhaust gas emissions from an internal combustion engine. A dosing device is fitted so that it can spray a reducing agent, such as a urea solution, into an exhaust passage. The dosing device 1 is mounted within a tubular port 10 of an exhaust passage 4 of an internal combustion engine. The dosing device comprises a nozzle body 6 defining an injection bore which is supplied with a solution of a reducing agent 2. The tubular port 10 protrudes from, and partially extends into, the exhaust passage 4. During operation, the dosing device 1 provides a spray of the reducing agent 2 into the exhaust passage 4.

The dosing device 1 may advantageously be constructed in accordance with embodiments of the invention as described here to achieve reliable dosing consistently between different dosing devices made according to the same design, wherein the design also allows for reliable and effective manufacture.

As indicated previously, this approach may be applied in other embodiments of the invention to other types of pump of the same general structure used for different purposes. Embodiments of the invention may similarly be used for an injector for a common rail diesel fuel injection system, or for other automotive uses such as for an engine pre-heater. This approach can be used to give similar effective dosing in other technical areas, such as medical dosing and manufacture of pharmaceuticals.

The invention claimed is:

1. A pumping assembly comprising:

a pump body with a pump bore, and a sleeve fixed axially within the pump bore and having a first end, a second end and a sleeve bore; and a plunger adapted to enter the first end of the sleeve and which reciprocates within the sleeve bore, such that a pumping chamber is partly defined by a leading face of the plunger and an interior side wall of the sleeve;

wherein the interior side wall of the sleeve has a first port and a second port which both allow fluid flow through the wall of the sleeve from a feed port into the pumping chamber, wherein passage of fluid into the pumping chamber through the first port and the second port is blocked when the plunger advances sufficiently far into the sleeve bore to cover the first port and the second port;

wherein the first port and the second port are each elongated in a circumferential direction substantially orthogonal to a direction of reciprocation;

wherein the first port and the second port are each formed as an elongate slot, and wherein respective long edges of each of the elongate slots are substantially parallel to each other; and wherein the first port and the second port each have a leading edge, wherein the leading edge is the long edge that is closest to the second end of the sleeve; and wherein the leading edge of one of the first and second ports is closer to the second end of the sleeve than the leading edge of the other of the first port and the second port.

2. The pumping assembly as claimed in claim 1, wherein the sleeve and the plunger are formed of a harder material than the pump body.

3. The pumping assembly as claimed in claim 2, wherein the harder material is a martensitic steel, wherein the pump body is formed of a ferritic steel.

4. The pumping assembly as claimed in claim 1, wherein the pumping assembly is adapted for use in an armature pump.

* * * * *